US005773204A

United States Patent [19]

Baumlin

[11] Patent Number: 5,773,204

[45] Date of Patent: Jun. 30, 1998

[54] PHOTOGRAPHIC COATING PROCESS

[75] Inventor: Jean Marie Baumlin, Chalon-sur-Saone, France

[73] Assignee: Eastman Kodak Company, Rochester, N.Y.

[21] Appl. No.: 819,218

[22] Filed: Mar. 17, 1997

Related U.S. Application Data

[63] Continuation of Ser. No. 538,088, Oct. 2, 1995, abandoned.

[30] Foreign Application Priority Data

Oct. 5, 1994 [FR] France ..... 94 12091

[51] Int. Cl.[6] ..... G03C 5/18; G03C 5/26

[52] U.S. Cl. ..... 430/449; 430/935; 430/523; 430/527; 430/631; 430/632; 430/633; 430/634; 430/635; 430/636; 430/637; 430/638

[58] Field of Search ..... 430/523, 527, 430/631, 632, 633, 634, 635, 636, 637, 638, 935, 449

[56] References Cited

U.S. PATENT DOCUMENTS

H1003 12/1991 Ishiwata et al. ..... 430/935

3,425,857 2/1969 Bacon et al. ..... 117/34

FOREIGN PATENT DOCUMENTS 0239363 3/1987 European Pat. Off. .

0267019 11/1987 European Pat. Off. .

0537779A1 10/1992 European Pat. Off. .

*Primary Examiner*—Geraldine Letscher

*Attorney, Agent, or Firm*—Arthur H. Rosenstein

[57] ABSTRACT

The invention concerns a process for coating a photographic support.

The process consists of depositing on a support a succession of at least two layers, at least one of which consists of a photosensitive composition, the top layer, situated at the opposite side to the support, containing a given concentration of at least one surfactant, the process being characterized in that a surfactant present in the top layer is introduced into the layer adjacent to the top layer at a concentration equal to at least 25% of the concentration of the same surfactant in the said top layer.

7 Claims, 2 Drawing Sheets

PHOTOGRAPHIC COATING PROCESS

This is a continuation of application Ser. No. 08/538,088, filed on Oct. 2, 1995, now abandoned.

FIELD OF THE INVENTION

The invention concerns the field of photography and in particular the field of photographic coating. The invention can be implemented by using various multilayer coating techniques such as bead coating or curtain coating.

BACKGROUND OF THE INVENTION

FIG. 1, to which reference is now made, illustrates diagrammatically a bead coating device. Photographic coating compositions $S_1$, $S_2$, $S_3$ and $S_4$ are introduced, at predetermined flow rates, into the respective cavities 2, 4, 6 and 8 by means of associated pumps $P_1$, $P_2$, $P_3$ and $P_4$. The coating solutions pass into respective pipes and flow by gravity through slots N1, N2, N3 and N4 onto an inclined surface. The solutions then leave the inclined surface, layered on top of each other. The layering thus produced is transferred onto a support 11 passing over a cylinder 10, disposed close to the end of the flow surface.

The deposition of such photographic layers can be effected in the same way by using a so-called curtain coating technique. Such a technique has been the subject of many publications in the literature and consequently does not require any additional description.

The deposition of such layers may be also be effected by using an extrusion coating technique as described for example in U.S. Pat. No. 2,761,417.

FIG. 2, to which reference is now made, illustrates diagrammatically a phenomenon which may occur in the field of photographic coating, in particular for coatings involving a number of layers greater than or equal to two and preferably greater than or equal to three, at least one of these liquid layers consists of a photosensitive composition. The phenomenon which has been observed experimentally is interpreted as being the result of a deformation of the top layer and a process of diffusion of the surfactant in the top layer towards the lower layers and, finally, a process of deformation of the photographic layers due to a movement brought about by differences in surface tension at different points on the surface of the top layer facing the atmosphere. The phenomenon has been observed on the film, after the point of contact with the support (or the coating point) but it may possibly occur on the inclined surface or on the layers in the curtain (in the case of curtain coating). Such examples of defects caused by the surface tension are described for example in the work entitled "Modern Coating and Drying Technology" by Edward Cohen and Edgar Gutoff, published by VCH, pages 130–134. As shown in FIG. 2, the phenomenon occurs when the top layer 21 has local variations in thickness such as, for example, an area of lesser thickness, as shown in FIG. 2. Traditionally, the top layer 21 includes surfactants intended to assist the spreading of the top layer on the intermediate layer. These surfactants diffuse from the top layer 21 to the intermediate layer 20, as indicated by the vertical arrows in FIG. 2. The depletion in surfactant resulting from this diffusion causes an increase in the surface tension. The smaller the average thickness of the top layer, the sooner this will occur. Thus the surface tension at the area of lesser thickness will be greater than the surface tension in the areas surrounding it, causing a movement of material as illustrated diagrammatically by the horizontal arrows and which affects substantially all the layers. This then creates variations in thickness in all the layers, significantly impairing the quality of coating of the photographic product.

According to known techniques, attempts have been made to resolve this problem in different ways. According to a first technique, the thickness of the top layer is increased so as to delay the appearance of the above-mentioned phenomenon to a time when the layers are set. This technique requires an increased quantity of water in the top layer, which increases the drying time and the cost of the final product. According to another technique, the setting time of the photographic layers is reduced. The drawback of such a solution lies in the fact that the setting time is a parameter which it is difficult to modify without modifying expensive equipment. Alternatively, the gelatin content of the layers can be increased, which sometimes may not be desirable. This solution may, moreover, not be effective if the phenomenon occurs on the inclined surface, in the curtain (in the case of curtain coating) or, very early on, on the support.

SUMMARY OF THE INVENTION

One of the objects of the present invention is therefore to provide a photographic coating process which does not present the problems mentioned above with reference to the prior art.

Other objects of the present invention will appear in detail in the following description.

According to the present invention, these objects are achieved by means of a photographic coating process consisting of depositing, on a support, a layered arrangement of at least two layers, at least one of which consists of a photosensitive composition, the top layer, containing a given concentration of at least one surfactant, the said process being characterized in that a surfactant present in the top layer is introduced into the layer adjacent to the said top layer at a concentration equal to at least 25% of the concentration of the said surfactant in the said top layer.

Advantageously, the surfactant added to the layer adjacent to the top layer has a concentration equal to at least 50% of the concentration of the same surfactant in the top layer.

Advantageously again, the surfactant added to the top layer has a concentration equal to at least 80% of the concentration of the same surfactant in the top layer.

According to a first embodiment, the photographic layers are deposited on the support by means of a meniscus or curtain coating technique.

According to a particular embodiment, the surfactant used is an Alkanol XC®.

BRIEF DESCRIPTION OF THE DRAWINGS

In the following description, reference will be made to the drawings in which.

DETAILED DESCRIPTION OF THE PREFERRED EMBODIMENTS

The photographic compositions forming the different layers are well known in the art and consequently do not require any additional description. By way of example, reference may be made to patent application EP-A-383 347 or patent application EP-A-439 172.

Traditionally, as mentioned above, the top layer of the photographic product contains one or more surfactants. Such surfactants may be anionic, non-ionic, cationic or amphoteric. Preferably, however, anionic or non-ionic surfactants are used. A non-exhaustive list of such surfactants is given in patent application EP-A-383 347. These surfactants are used alone or in combination with one or more other surfactants. Among the compounds appearing in the list of surfactants cited in the above-mentioned application, those which are able to diffuse wholly or partly from one layer to another will be selected. Examples of these would be salts of carboxylic acids, salts of sulphonic acids, esters of sulphuric acids, esters of polyphosphoric and phosphoric acids, perfluorinated surfactants, alkylphenol polyoxyethylenes, straight-chain alcohol polyoxyethylenes and long-chain carboxylic acid esters. Satisfactory results have been obtained by using Alkanol XC®, the formula of which is:

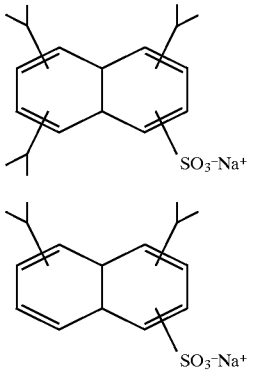

According to a particular embodiment, the top layer contains 0.1% of such a surfactant.

According to the present invention, a quantity of surfactant present in the top layer is added to the layer adjacent to the top layer in sufficient quantity to reduce substantially the diffusion of surfactants from the top layer to the adjacent layer. When the top layer contains more than one surfactant, preference is given to using, as a surfactant in the adjacent layer, the one or ones whose diffusion would cause the most substantial increase in the surface tension in an area of lesser thickness as mentioned above. An appreciable improvement in the quality of the photographic coating was observed when the concentration of surfactant added to the intermediate layer is equal to at least 25% of the concentration of the same surfactant in the top layer. The concentration is preferably at least 50%. Preferably again, the concentration of surfactant in the intermediate layer is equal to at least 80% of the concentration of the same surfactant in the top layer.

EXAMPLE 1 (COMPARATIVE)

On a transparent photographic support, a succession of three layers is deposited: a bottom layer, a top layer and an intermediate layer. The thickness of the intermediate layer is identical to that of the top layer. The coating speed is 2 m/s.

Bottom layer:

4% gelatin

Dispersion of carbon black to obtain an optical density of 1

Water

Viscosity: 4 mPa.s

T°: 40° C.

Thickness: 40 $\mu$m

Intermediate layer:

11% gelatin

Water

Viscosity: approximately 25 mpa.s

T°: 40° C.

Top layer:

11% gelatin 0.1% surfactant (1 g/kg Alkanol XC®)

Water

Viscosity: approximately 25 mPa.s

T°: 40° C.

Figure 1:
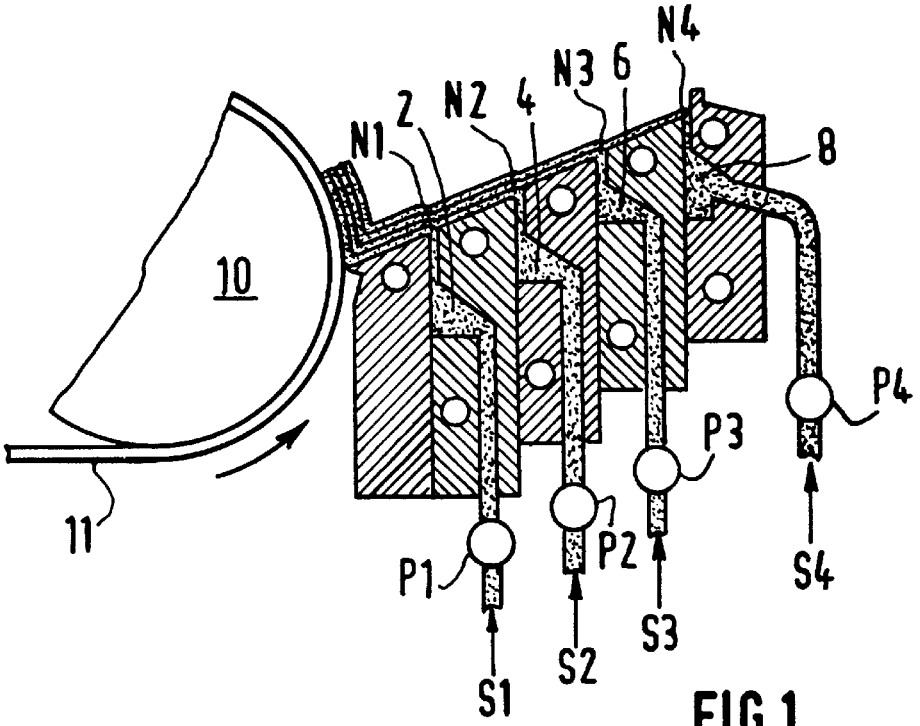
FIG. 1 shows diagrammatically an example of a device which can be used for implementing the process according to the invention.
Figure 2:
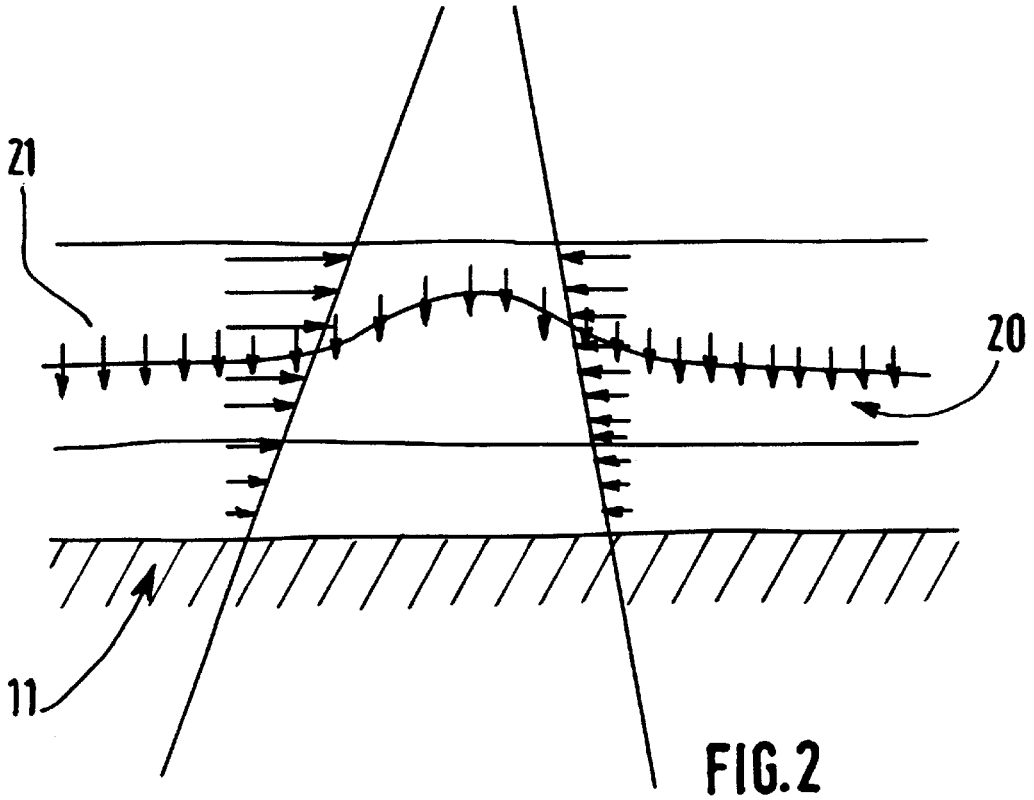
FIG. 2 illustrates diagrammatically the problem which the process according to the present invention sets out to resolve.
Figure 3:
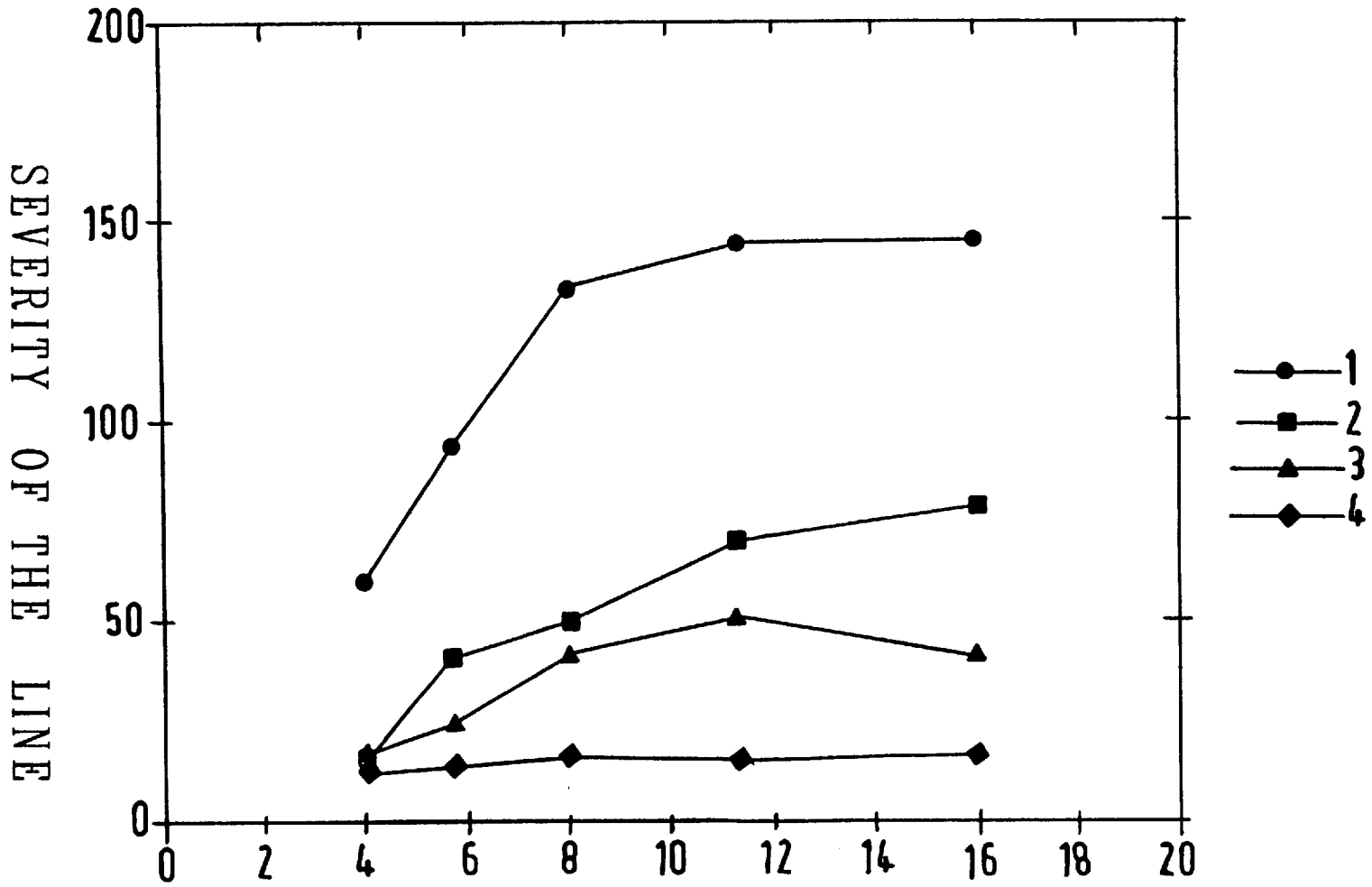
FIG. 3 shows the effects of the method according to the invention on the quality of the coating obtained, in comparison with the prior art.

The lines formed by particles of plastic (around 2 mm in diameter) are observed, which are disposed around the slot from which the intermediate layer flows (either above, or below, or inside). The severity of the lines is measured by using a CCD camera, for different thicknesses of the top layer (typically between 4 $\mu$m and 16 $\mu$m). The CCD camera measures, by transmission, the optical density of the coating obtained. According to this example, the height of the perturbation is measured as a percentage with respect to the thickness of the layer. The results are shown by curve 1 in FIG. 3.

EXAMPLE 2

The same conditions are used as those used in Example 1, adding to the intermediate layer a 0.05% concentration (i.e. 0.5 g/kg) of the surfactant present in the top layer. The results are shown by curve 2 in FIG. 3. As can be seen clearly, the lines are substantially less severe than the lines obtained without a surfactant in the intermediate layer.

EXAMPLE 3

The same conditions are used as those used in Examples 1 and 2, adding, to the intermediate layer, a 0.08% concentration (i.e. 0.8 g/kg) of the surfactant present in the top layer. The results are entered on curve 3 in FIG. 3. Once again the curve shows an appreciable improvement compared with the previous conditions.

EXAMPLE 4

The same conditions are used as those used in the previous examples, this time adding the surfactant to the intermediate layer in a concentration equal to that of the surfactant in the top layer (i.e. 0.1% or 1 g/kg). The results with regard to the severity of the lines are entered on curve 4 in FIG. 3.

As is clear from the above examples, the method according to the invention substantially improves the quality of the photographic coating obtained without the addition of surfactant to the reduction layer.

Even though the problem is more appreciable when there are more than three layers, the problem also exists when the photographic product includes only two layers. The process according to the invention which has just been described above may be applied in the same way for such a structure with two layers.

The invention has just been described with reference to preferred embodiments. These embodiments are obviously given only by way of example, and variations may be made thereto without departing from the spirit of the invention as claimed.

I claim:

1. Photographic coating process consisting of depositing on a support an assembly of at least two superimposed liquid layers, at least one of which consists of a photosensitive composition, said assembly including a top liquid layer and at least one intermediate liquid layer between said top liquid layer and said support, the top liquid layer containing a given concentration of at least one surfactant, said process being characterized in that a surfactant present in the top liquid layer is introduced into the intermediate liquid layer adjacent to said top liquid layer at a concentration equal to at least 50% of the concentration of said surfactant in said top liquid layer.

2. Process according to claim 1, characterized in that said assembly includes at least three layers.

3. Process according to claim 1 or 2, characterized in that the surfactant added to the intermediate liquid layer adjacent to said top liquid layer has a concentration equal to at least 80% of the concentration of the same surfactant in the top layer.

4. A process according to claim 1, characterized in that the said layers are deposited on the support by a bead coating technique.

5. A process according to claim 1, characterized in that the said layers are deposited on the support by a curtain coating technique.

6. A process according to claim 1, characterized in that the thickness of the top layer varies between 4 $\mu$m and 16 $\mu$m.

7. A process according to claim 1, characterized in that the said surfactant is Alkanol XC®.

* * * * *

UNITED STATES PATENT AND TRADEMARK OFFICE

CERTIFICATE OF CORRECTION

PATENT NO. : 5,773,204
DATED : 30 June 1998
INVENTOR(S) : Jean-Marie Baumlin

It is certified that error appears in the above-identified patent and that said Letters Patent is hereby corrected as shown below:

| | |
|---|---|
| Cover Page | Change "Jean Marie Baumlin" to --Jean-Marie Baumlin-- |
| Column 5, line 16 | Change "claim 1 or 2;" to --claim 1-- |

Signed and Sealed this

Twenty-fourth Day of November, 1998

*Attest:*

*Attesting Officer*

BRUCE LEHMAN

*Commissioner of Patents and Trademarks*